US010337267B1

(12) United States Patent
Wang et al.

(10) Patent No.: US 10,337,267 B1
(45) Date of Patent: Jul. 2, 2019

(54) CONTROL METHOD AND CONTROL DEVICE FOR DRILLING OPERATIONS

(71) Applicant: CHINA UNIVERSITY OF PETROLEUM (EAST CHINA), Qingdao (CN)

(72) Inventors: Zhiyuan Wang, Qingdao (CN); Shaowei Pan, Qingdao (CN); Baojiang Sun, Qingdao (CN); Jianbo Zhang, Qingdao (CN); Jing Yu, Qingdao (CN)

(73) Assignee: CHINA UNIVERSITY OF PETROLEUM (EAST CHINA) (CN)

( * ) Notice: Subject to any disclaimer, the term of this patent is extended or adjusted under 35 U.S.C. 154(b) by 0 days.

(21) Appl. No.: 16/122,656

(22) Filed: Sep. 5, 2018

(51) Int. Cl.
*E21B 21/08* (2006.01)
*E21B 43/34* (2006.01)
*E21B 44/00* (2006.01)

(52) U.S. Cl.
CPC ..... *E21B 21/08* (2013.01); *E21B 44/00* (2013.01); *E21B 43/34* (2013.01)

(58) Field of Classification Search
CPC ..... E21B 21/08; E21B 44/00
See application file for complete search history.

(56) References Cited

U.S. PATENT DOCUMENTS 6,394,195 B1 * 5/2002 Schubert ..... E21B 21/001 166/359
7,027,968 B2 * 4/2006 Choe ..... E21B 21/001 175/60
7,407,019 B2 * 8/2008 Kinder ..... E21B 21/08 175/38
9,051,803 B2 * 6/2015 Leuchtenberg ..... E21B 7/00
9,612,187 B1 * 4/2017 Sun ..... G01N 15/0826
9,631,444 B1 * 4/2017 Sun ..... E21B 21/08
9,638,031 B2 * 5/2017 Li ..... E21B 21/08
9,909,374 B2 * 3/2018 Mehrabian ..... E21B 47/06
2015/0233198 A1 * 8/2015 Leuchtenberg ..... E21B 7/00 175/25
2018/0135365 A1 * 5/2018 Knudsen ..... E21B 21/106

* cited by examiner

*Primary Examiner* — Nicole Coy
(74) *Attorney, Agent, or Firm* — Calfee, Halter & Griswold, LLP

(57) ABSTRACT

The invention relates to the field of stratum drilling, and in particular to a control method and a control device for drilling operations. The control method comprises: detecting whether an overflow occurs in a well; controlling the wellhead back pressure based on a preset bottom hole pressure when no overflow occurs in the well, in order to keep the bottom hole pressure stable; and performing a shut-in operation and controlling the wellhead back pressure based on the increase in fluid discharge returned from an annulus of the well when an overflow occurs in the well, so as to keep the bottom hole pressure stable and prevent the gas in the stratum from continuing to invade into the drilling fluid during the process that the overflow drilling fluid is discharged from the bottom of the well. The control method and control device make it possible to prevent drastic fluctuation of the wellhead back pressure caused by the expansion of the invaded gases during the discharge thereof during the drilling operation, thereby realizing the stable control of the wellhead back pressure.

10 Claims, 9 Drawing Sheets

CONTROL METHOD AND CONTROL DEVICE FOR DRILLING OPERATIONS

CROSS REFERENCE TO RELATED APPLICATION

This application claims the benefit of Chinese application No. 201810384801.0 filed Apr. 26, 2018, the contents of which are hereby incorporated by reference herein.

FIELD OF THE INVENTION

The invention relates to the field of stratum drilling, and in particular to a control method and a control device for drilling operations.

BACKGROUND OF THE INVENTION

With the deepening of oil and gas exploration and development, there are more and more deep wells, ultra-deep wells and deep-water wells. During the drilling process, it is faced with complex stratum conditions such as multilayered reservoir, multiple sets of pressure systems, high pressure, high sulfur content, cracks, and cavern development. The pore pressure, leakage pressure, and fracture pressure in the stratum are close to each other, and the special working conditions with a narrow safety density window often cause problems such as frequent downhole failures and long drilling cycles, which seriously restrict the oil and gas exploration and development process.

Managed pressure drilling is an adaptive drilling process that precisely controls the entire borehole pressure profile. Through the comprehensive analysis of wellhead back pressure, fluid density, fluid rheology, annulus liquid level, cycle friction and borehole geometry, the hydraulic parameters can be accurately calculated. Real-time adjustment of wellhead back pressure and drilling fluid flow rate is achieved by means of related equipment and processes to control bottom hole pressure within the preset range. The managed pressure drilling technology can effectively prevent accidents such as well leakage and well collapse, increase the mechanical rotation speed, shorten the non-productive time, and at the same time reduce the damage caused by drilling operations to the reservoir.

In the normal drilling process, there are only drilling fluids and cuttings in the annulus, and the back pressure adjustment at the wellhead is relatively easy. When gas invades the wellbore (i.e., gas invasion, the process by which a gas invades the drilling fluid to lower the drilling fluid column pressure and disable the integrity of the wellbore), due to gas phase change, dissolution, slippage, and gas-liquid flow pattern transition, the following problems will be brought to the wellbore pressure precision adjustment system. First, in the case that a well is shut in (which is semi-soft shut-in) due to gas invasion, there is a certain water hammer pressure that may cause damage to the blowout preventer and throttling pipeline and increase the risk of pressure leakage in the exposed stratum. Second, in the case the gas content of the annulus is high after gas invasion, the flow pattern of gas-liquid two-phase is slug flow. There is a significant difference between the flow rate of the liquid slug section and the gas section when passing through the throttling valve and the pressure difference before and after passing through the throttling valve. As a result, there is a periodic large fluctuation in the wellhead back pressure, making it difficult to achieve stable control of wellbore annulus and bottom hole pressure.

When acid gases such as $H_2S$ and $CO_2$ intrude into the wellbore, the acid gas is in a supercritical state with a high degree of compression when the depth of the well is deep. When it is close to the wellhead, the phase transition occurs and the acid gases change from a supercritical state to a gas phase. As a result, the density rapidly decreases and the volume rapidly expands." Due to this behavior of the natural gas with high acid gas content, the gas invasion would be in greater extent hidden in the lower wellbore, accompanied with the abrupt kick in the upper wellbore, which makes it difficult to control the wellhead pressure stably.

SUMMARY

An object of embodiments of the present invention is to provide a control method and a control device for drilling operations that can prevent drastic fluctuation of the wellhead back pressure caused by the expansion of the invaded gases during the discharge thereof during the drilling operations, thereby realizing the stable control of the wellhead back pressure.

To this end, embodiments of the present invention provide a control method for drilling operations, comprising: detecting whether an overflow occurs in a well; controlling the wellhead back pressure based on a preset wellhead back pressure when no overflow occurs in the well, in order to keep the bottom hole pressure stable; and performing a shut-in operation and controlling the wellhead back pressure based on an increase in fluid discharge returned from an annulus of the well when an overflow occurs in the well, so as to keep the bottom hole pressure stable and prevent the gas in the stratum from continuing to invade into the drilling fluid during the process that the overflow drilling fluid is discharged from the annulus of the well.

Detecting whether an overflow occurs in a well comprises: detecting the discharge amount of fluid returned from the annulus of the well; and determining whether an overflow occurs in the well based on the discharge amount of fluid.

The control method further comprises: separating the liquid and gas in the overflow drilling fluid after the overflow drilling fluid is discharged out of the well, when an overflow occurs in the well.

Controlling the wellhead back pressure based on the increase in fluid discharge returned from an annulus of the well comprises: controlling the wellhead back pressure to a first back pressure in an initial stage after the shut-in operation; controlling the wellhead back pressure to a second back pressure after the initial stage lasting for a predetermined period of time and before gas overflow is detected at the wellhead; and controlling the wellhead back pressure to a third back pressure when overflow gas is detected at the wellhead.

The first back pressure is determined by the following formula:

$$p_{a0} = p_d + \frac{V_{K0}}{A_a}(\rho_m - \rho_{g1})g,$$

$$p_{g1} = \frac{z_0(p_d + p_b)T_0}{z_1 p_0 T_b}\rho_{g0},$$

wherein $p_{a0}$ is the first back pressure, $V_{k0}$ is the increase in fluid discharge when the overflow occurs, $p_d$ is the read riser pressure, $A_a$ is the cross-sectional area of the annulus of the open hole section, $\rho_{a1}$ is the density of the drilling fluid when no invaded gas is present, $\rho_{g1}$ is the density of a invaded gas at the bottom of the well, $z_0$ is the methane compression factor in the standard state, $T_0$ is a temperature in the standard state, $p_0$ is the standard atmospheric pressure, $\rho_{g0}$ is the methane density in the standard state, $T_b$ is the bottom hole temperature, $z_1$ is the methane compression factor at bottom hole temperature and pressure conditions, and $p_b$ is the designed bottom hole pressure.

The second back pressure is determined by the following formula:

$$p_{a1}=p_{a0}+p_{ml},$$

$$p_{ml}=\frac{V_{k1}}{A_{ai}}(\rho_m-\rho_{gi})g,$$

$$\rho_{gi}=\frac{z_0(p_d+p_b-\rho_m g h_i)T_0}{z_i p_0 T_i}\rho_{g0},$$

wherein $p_{a1}$ is the second back pressure, $V_{k1}$ is the increase in fluid discharge when the overflow drilling fluid rises to a depth $h_i$, $A_{ai}$ is the cross-sectional area of the annulus at the well depth $h_i$, $p_{ml}$ is the pressure loss of the drilling fluid column caused before the overflow drilling fluid reaching the wellhead, $\rho_{gi}$ is the density of the overflow drilling fluid when it rises to the well depth $h_i$, $z_i$ is the methane compression factor under the temperature and pressure conditions at the well depth $h_i$, $T_i$ is the temperature at $h_i$, $h_i$ being calculated based on pump displacement, gas slippage rate and the predetermined period of time.

The third back pressure is determined by the following formula:

$$p_{a2}=p_{a0}+p_{ml2}$$

$$p_{ml2}=\frac{V_{k2}}{A_{a0}}(\rho_m-\rho_{g2})g$$

$$\rho_{g2}=\frac{z_0 p_{a2} T_0}{z_2 p_0 T_2}\rho_{g0}$$

wherein $p_{a2}$ is the third back pressure, $A_{a0}$ is the cross-sectional area of the annulus at the wellhead, $V_{k2}$ is the increase in fluid discharge when the overflow drilling fluid reaches the wellhead, $p_{ml2}$ is the pressure loss of the drilling fluid column caused when the overflow drilling fluid reaches the wellhead, $\rho_{g2}$ is the density of the gas when the gas reaches the wellhead, $z_2$ is the methane compression factor under the temperature and pressure conditions at the wellhead, and $T_2$ is the temperature at the wellhead.

The control method further comprises, after performing the shut-in operation: determining whether the gas contains an acid gas based on the actual increase in fluid discharge and a calculated value of the increase in fluid discharge, the calculated value of the increase in fluid discharge is calculated according to a gas state equation; calculating, the total amount of the acid gas based on a methane solubility chart, an acid gas solubility chart, a pressure distribution of the annulus, and the total gas volume; calculating a critical pressure for keeping the acid gas in the supercritical state based on the total amount of the acid gas, a temperature and pressure field of the wellbore, a dissolution pattern and phase state curve of the acid gas; and regulating the wellhead back pressure based on the critical pressure to prevent gas in the stratum from continuing to invade the drilling fluid.

Regulating the wellhead back pressure based on the critical pressure comprises: regulating the wellhead back pressure based on a stage corresponding to the first back pressure, the second back pressure, and the third back pressure respectively, and a maximum value between the fourth back pressure and one of the first back pressure, the second back pressure, and the third back pressure.

The control method further comprises: neutralizing, if the gas contains an acid gas, the acid gas after the overflow drilling fluid is discharged out of the well and before the liquid and gas in the overflow drilling fluid are separated, in order to prevent the acid gas from sudden expansion.

The preset wellhead back pressure is determined by the following formula:

$$p_a=p_b-p_m-p_t$$

wherein $p_a$ is the preset wellhead back pressure, $p_b$ is the preset bottom hole pressure, $p_t$ is a friction pressure drop, and $p_m$ is a drilling fluid column pressure.

According to another aspect of the present invention, there is provided a control device for drilling operations, wherein the control device comprises: a detection module configured to detect whether an overflow occurs in a well; a control module configured to: control the back pressure at wellhead based on a preset wellhead back pressure when no overflow occurs in the well, in order to keep the bottom hole pressure stable; and perform a shut-in operation and control the wellhead back pressure based on an increase in fluid discharge returned from an annulus of the well when an overflow occurs in the well, so as to keep the bottom hole pressure stable and prevent the gas in the stratum from continuing to invade the drilling fluid during the process that the overflow drilling fluid is discharged from the bottom of the well.

Detecting whether an overflow occurs in a well comprises: detecting the discharge amount of fluid returned from the annulus of the well; and determining whether an overflow occurs in the well based on the discharge amount of fluid.

The control device further comprises: a gas-liquid separation module configured to separate the liquid and gas in the overflow drilling fluid after the overflow drilling fluid is discharged out of the well, when an overflow occurs in the well.

Controlling the wellhead back pressure based on the increase in fluid discharge comprises: controlling the wellhead back pressure to a first back pressure in an initial stage after the shut-in operation; controlling the wellhead back pressure to a second back pressure after the initial stage lasting for a predetermined period of time and before gas overflow is detected at the wellhead; and controlling the wellhead back pressure to a third back pressure when gas overflow is detected at the wellhead.

The first back pressure is determined by the following formula:

$$p_{a0}=p_d+\frac{V_{K0}}{A_a}(\rho_m-\rho_{g1})g,$$

$$p_{g1}=\frac{z_0(p_d+p_b)T_0}{z_1 p_0 T_b}\rho_{g0},$$

wherein $p_{a0}$ is the first back pressure, $V_{k0}$ is the increase in fluid discharge when the overflow occurs, $p_d$ is the read riser pressure, $A_a$ is the cross-sectional area of the annulus of the open hole section, $\rho_m$ is the density of the drilling fluid when no invaded gas is present, $\rho_{g1}$ is the density of a invaded gas at the bottom of the well, $z_0$ is the methane compression factor in the standard state, $T_0$ is a temperature in the standard state, $p_0$ is the standard atmospheric pressure, $\rho_{g0}$ is the methane density in the standard state, $T_b$ is the bottom hole temperature, $z_1$ is the methane compression factor at bottom hole temperature and pressure conditions, and $p_b$ is the designed bottom hole pressure.

The second back pressure is determined by the following formula:

$$p_{a1}=p_{a0}+p_{ml},$$

$$p_{ml} = \frac{V_{k1}}{A_{ai}}(\rho_m - \rho_{gi})g,$$

$$\rho_{gi} = \frac{z_0(p_d + p_b - \rho_m g h_i)T_0}{z_i p_0 T_i}\rho_{g0},$$

wherein $p_{a1}$ is the second back pressure, $V_{k1}$ is the increase in fluid discharge when the overflow drilling fluid rises to a depth $h_i$, $A_{ai}$ is the cross-sectional area of the annulus at the well depth $h_i$, $p_{ml}$ is the pressure loss of the drilling fluid column caused before the overflow drilling fluid reaching the wellhead, $\rho_{gi}$ is the density of the overflow drilling fluid when it rises to the well depth $h_i$, $z_i$ is the methane compression factor under the temperature and pressure conditions at the well depth $h_i$, $T_i$ is the temperature at $h_i$, $h_i$ being calculated based on pump displacement, gas slippage rate and the predetermined period of time.

The third back pressure is determined by the following formula:

$$p_{a2}=p_{a0}+p_{ml2}$$

$$p_{ml2} = \frac{V_{k2}}{A_{a0}}(\rho_m - \rho_{g2})g$$

$$\rho_{g2} = \frac{z_0 p_{a2} T_0}{z_2 p_0 T_2}\rho_{g0}$$

wherein $p_{a2}$ is the third back pressure, $A_{a0}$ is the area cross-sectional area of the annulus at the wellhead, $V_{k2}$ is the increase in fluid discharge when the overflow drilling fluid reaches the wellhead, $p_{ml2}$ is the pressure loss of the drilling fluid column caused when the overflow drilling fluid reaches the wellhead, $\rho_{g2}$ is the density of the gas when it reaches the wellhead, $z_2$ is the methane compression factor under the temperature and pressure conditions at the wellhead, and $T_2$ is the temperature at the wellhead.

The control module is further configure to, after performing the shut-in operation: determine whether the gas contains an acid gas based on the actual increase in fluid discharge and a calculated value of the increase in fluid discharge, the calculated value of the increase in fluid discharge is calculated according to a gas state equation; calculate, if the gas contains an acid gas, the total amount of the acid gas based on a methane solubility chart, an acid gas solubility chart, a pressure distribution of the annulus, and the total gas volume; calculate a critical pressure for keeping the acid gas in the supercritical state based on the total amount of the acid gas, a temperature and pressure field of the wellbore, a dissolution pattern and phase state curve of the acid gas; and regulate the wellhead back pressure based on the critical pressure to prevent gas in the stratum from continuing to invade the drilling fluid.

Regulating the wellhead back pressure based on the critical pressure comprises: calculating the fourth back pressure based on the critical pressure; and regulating the wellhead back pressure based on a stage corresponding to the first back pressure, the second back pressure, and the third back pressure respectively, and a maximum value between the fourth back pressure one of the first back pressure, the second back pressure, and the third back pressure.

The control device further comprises: a neutralizing module connected to the gas-liquid separation module and configured to, if the gas contains an acid gas, inject a neutralization solution into the liquid in the gas-liquid separation module to neutralize the acid gas after the overflow drilling fluid is discharged out of the well and before the liquid and gas in the overflow drilling fluid are separated, in order to prevent the acid gas from sudden expansion.

The preset wellhead back pressure is determined by the following formula:

$$p_a=p_b-p_m-p_t$$

wherein $p_a$ is the preset wellhead back pressure, $p_b$ is the bottom hole design pressure, $p_t$ is a friction pressure drop, and $p_m$ is a drilling fluid column pressure.

The gas-liquid separation module comprises a gas-liquid separation tank connected to the wellhead, the control device further comprises: a back pressure regulating module connected to the gas-liquid separation tank and the control module, and configured to regulate the wellhead back pressure by regulating the pressure in the gas-liquid separation tank based on control of the control module.

The back pressure regulating module comprises: a first gas source containing a gas for regulating pressure; a back pressure valve module connected to the first gas source via a first regulating valve, the gas separated by the gas-liquid separation tank is discharged through the back pressure valve module, the control module controls the opening degree of the first regulating valve to regulate the amount of gas for regulating pressure entering the back pressure valve module from the first gas source, whereby the amount of gas flowing out of the gas-liquid separation tank is controlled by regulating the action of the back pressure valve module; and a pressure compensation module comprising a second gas source, the second gas source is in communication with the gas-liquid separation tank and the back pressure valve module via a second regulating valve, the control module controls opening and closing of the second regulating valve to regulate the amount of gas for regulating pressure entering the gas-liquid separation tank from the second gas source, whereby the pressure in the gas-liquid separation tank is regulated.

The gas-liquid separation module comprises a multi-stage gas-liquid separation submodule, and an outlet of a gas-liquid separation submodule of the preceding stage is connected to an inlet of a gas-liquid separation submodule of the next stage.

According to a further aspect of the present invention, there is provided a machine-readable storage medium having instructions stored thereon for causing a machine to perform the control method.

With the above technical solutions, the present invention makes it possible to control the wellhead back pressure according to the discharge amount of overflow when an overflow is detected, further control the back pressure in stages according to an increase of the overflow discharge during rising of the overflow from the bottom of the well, and separate the gas phase from the liquid phase, so as to realize stable control of the wellhead back pressure to buffer the pressure fluctuation caused by shut-in operation and expansion of the invaded gas and avoid damage to the pipelines caused by the water hammer pressure.

Other features and advantages of the embodiments of the present invention will be described in detail in the following detailed description.

BRIEF DESCRIPTION OF THE DRAWINGS

The drawings are provided to facilitate further understanding of the embodiments of the present invention, form a part of the specification and used to explain the present invention along with the embodiments described hereinafter, but in no way limit the scope of the present invention. In these drawings.

LIST OF REFERENCE SIGNS

1. pressure gauge; 2. computer; 3. stop valve; 4. first-stage gas-liquid separation tank; 5. bolt; 6. filter shell separation chamber; 7. check valve; 8. pressure reducing valve; 10, gas source; 11. pressure gauge; 12, pressure reducing valve; 13. throttle valve; 14, gas cylinder; 15, back pressure valve; 16. gas-operated back pressure valve; 17. stop valve; 18. throttle valve; 19. neutralization solution injection pump; 20. neutralization solution storage tank; 21. first-stage gas-liquid separation tank filter shell; 22. level gauge; 23. throttle valve; 24. second-stage gas-liquid separation tank; 25. throttle valve; 26. solid control system; 27. check valve; 28. check valve; 29. throttle valve; 30. burner; 31. throttle valve; 32. adjustable flow valve; 33. pressure gauge; 34. drilling fluid gas-liquid separator interface; 35. support plate; 36. fine mesh; 37. sealing gasket; 38. fine filter exhaust pipe; 39. liquid separation plate; 40. top cover; 41. corrosion-resistant piston; 42. bolt; 43. gasket; 44. sealing piece; 45. main body; 46. mounting hole; 50. wellhead device; 100. detection module; 200. control module; 300. gas-liquid separation module; 400. neutralization module; 500: back pressure regulating module

DETAILED DESCRIPTION OF THE INVENTION

The following describes the embodiments of the present invention with reference to the drawings. It would be appreciated that the embodiments described here are intended to illustrate and explain, rather than limit the present invention.

Figure 1:
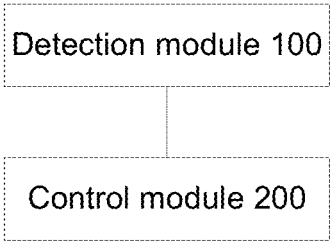
FIG. 1 is a structural block diagram of a control device according to an embodiment of the present invention.

FIG. 1 is a structural block diagram of a control device according to an embodiment of the present invention. As shown in FIG. 1, the control device for drilling operations comprises a detection module 100 and a control module 200.

Figure 6A:
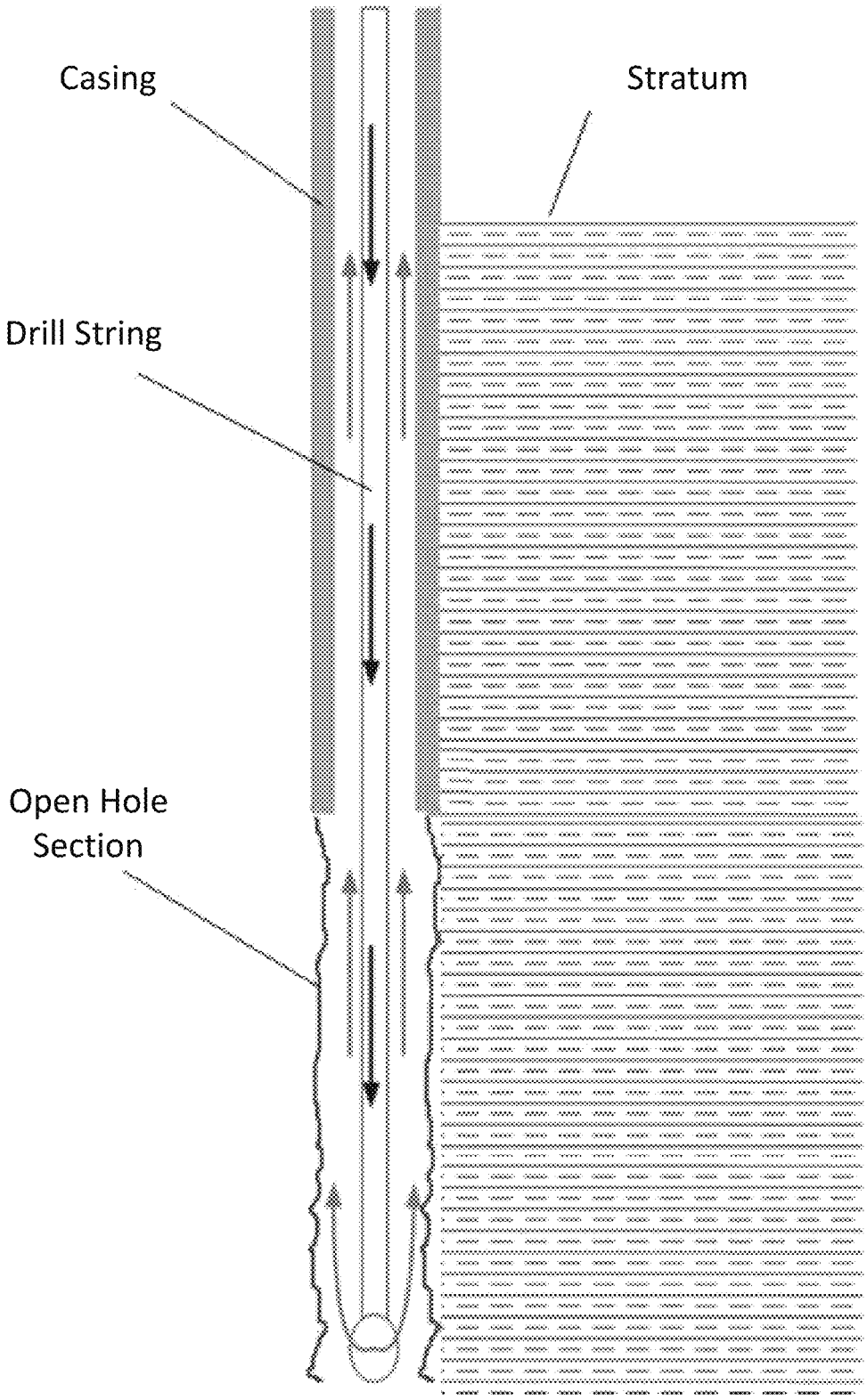
FIGS. 6A and 6B are cross-sectional views for illustrating different well sections during drilling.

The detection module 100 is configured to detect whether an overflow occurs in the well. In the present invention, overflow refers to a substance (gas or liquid (such as oil, water, etc.)) that intruded into the wellbore. The substance intruded into the drilling fluid and occupies a portion of the annulus volume, forcing the drilling fluid originally occupying this volume to return out of the wellhead, resulting in an increase in the drilling fluid discharge returned at the wellhead. When the invaded substance is a gas, because the gas has high compressibility, the volume of the gas expands during the gas rising process due to change in the temperature and pressure conditions, leading to a further increase in the fluid discharge returned at the wellhead. As shown in FIG. 6A, during the drilling process, the drilling fluid enters the well from the drill string, passes through the drill bit, and returns upwards to the drilling fluid pool (not shown in FIG. 6A) through the annulus. The arrow in FIG. 6A indicates the flow direction of the drilling fluid. In the absence of gas invasion, the amount of injected drilling fluid and returned drilling fluid will remain approximately the same at all times. However, when there is gas invasion, since the returned drilling fluid contains invaded gas which expands and dissolves out due to the change of the environmental conditions during the rising process, there will be more returned drilling fluid than when there is no gas invasion. Therefore, it is possible to determine whether an overflow occurs by detecting an increase in the drilling fluid discharge during the drilling process. For example, it may be determined that an overflow has occurred when the level of the drilling fluid pool is detected to rise.

The control module 200 is configured to perform the following operations:

The control module 200 controls the wellhead back pressure based on a preset wellhead back pressure when no overflow occurs in the well, in order to keep the bottom hole pressure stable.

In a preferred embodiment, during normal drilling process with no overflow occurs, the preset wellhead back pressure is determined by the following equation:

$$p_a = p_b - p_m - p_t$$

wherein $p_a$ is the preset wellhead back pressure, $p_b$ is the designed bottom hole pressure, $p_t$ is a friction pressure drop, and $p_m$ is a drilling fluid column pressure. The drilling fluid column pressure can be determined by the formula for calculating fluid pressure based on the well depth and the density of drilling fluid, and the friction pressure drop can be determined by a method well known in the art.

When an overflow occurs in the well, the control module 200 is configured to perform a shut-in operation and control the wellhead back pressure based on an increase in fluid discharge returned from annulus of the well when an overflow occurs in the well, so as to keep the bottom hole pressure stable and prevent the gas in the stratum from continuing to invade the drilling fluid during the process that the overflow drilling fluid is discharged from the bottom of the well. The overflow drilling fluid refers to drilling fluid that is invaded by gas after overflow occurs.

The shut-in is to temporarily suspend the circulation of the drilling fluid in order to read parameters such as riser pressure, amount of overflow, and stratum pressure. After the above parameters are read, a well-killing operation is carried out. When performing the well-killing operation, first the degraded drilling fluid invaded by gas is discharged, and the weighted drilling fluid (called new drilling fluid, which has a greater density than the original drilling fluid), so as to restore normal drilling operations. During the process that the overflow drilling fluid is discharged from the bottom of the well to the wellhead, the gas solubility and density decrease and the volume expands, due to the fact that the temperature and pressure vary at different well depths and that the closer the overflow drilling fluid is to the wellhead, the lower the pressure is. In addition, the acid gas contained in the overflow may change from a dissolved state or a supercritical state to a gaseous state. If the pressure is not controlled, sudden expansion will occur when the overflow drilling fluid approaches the wellhead or is discharged through the wellhead, resulting in unstable wellbore pressure control. Therefore, during the process that the overflow drilling fluid is discharged from the bottom of the well to the wellhead, it is necessary to control the wellhead back pressure to a value at which the dissolved or supercritical acid gas in the overflow does not undergo phase change.

During drilling, a certain pressure needs to be maintained at the bottom of the well in order to prevent gas in the stratum from invading the drilling fluid. The bottom hole pressure consists of three parts, i.e. wellhead back pressure, annulus friction drag, and drilling fluid column pressure. In normal drilling, the bottom hole pressure is greater than or equal to the stratum pressure. However, when gas invasion occurs at the bottom of the well, the invaded gas occupies a certain amount of space in the annulus. Because the total volume of the annulus is limited, excessive drilling fluid will be discharged from the annulus through the wellhead. Because the gas has a lower density than the drilling fluid, the drilling fluid column pressure in the annulus is reduced, resulting in a decrease in bottom hole pressure and further causing overflow. In the present invention, in the normal drilling process in which overflow does not occur, if the fluid column pressure can maintain a sufficient bottom hole pressure, the wellhead back pressure can be 0. If the fluid column pressure is insufficient to maintain the required bottom hole pressure, the bottom hole pressure can be maintained at the designed bottom hole pressure by applying back pressure at the wellhead. When overflow occurs at the bottom of the well, the bottom hole pressure can also be kept stable by controlling the wellhead back pressure during the discharge of the overflow drilling fluid, so as to prevent the gas from continuing to invade the drilling fluid.

Through this embodiment, not only the bottom hole pressure can be maintained as the designed bottom hole pressure value by controlling the wellhead back pressure during the normal drilling process, but also the occurrence of the overflow can be monitored in time. And further, by controlling the wellhead back pressure during the rise of overflow drilling fluid, it is possible to discharge the overflow drilling fluid without impacting the pipeline while maintaining the stability of the bottom hole pressure and preventing the gas from continuing to invade the drilling fluid.

Figure 2:
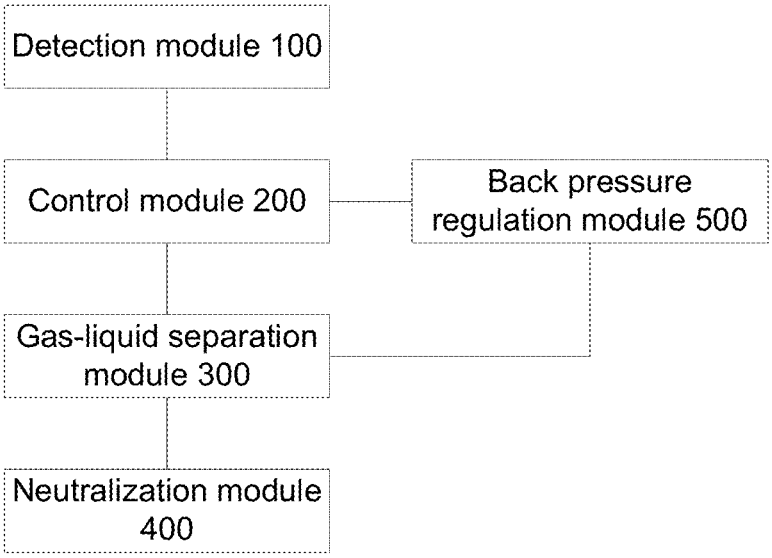
FIG. 2 is a structural block diagram of a control device according to another embodiment of the present invention.

FIG. 2 is a structural block diagram of a control device according to an embodiment of the present invention.

As shown in FIG. 2, in a preferred embodiment, the control device further comprises one or more of the following: a gas-liquid separation module 300 configured to separate the liquid and gas in the overflow drilling fluid after the overflow drilling fluid is discharged out of the well when an overflow occurs in the well, the gas-liquid separation module 300 preferably comprises a gas-liquid separation tank; a neutralizing module 400 connected to the gas-liquid separation module and configured to, if the gas contains an acid gas, inject a neutralization solution into the liquid in the gas-liquid separation module to neutralize the acid gas after the overflow drilling fluid is discharged out of the well and before the liquid and gas in the overflow drilling fluid are separated, in order to prevent the acid gas from sudden expansion; and a back pressure regulating module 500 connected to the gas-liquid separation tank and configured to regulate the wellhead back pressure by regulating the pressure in the gas-liquid separation tank.

Figure 3:
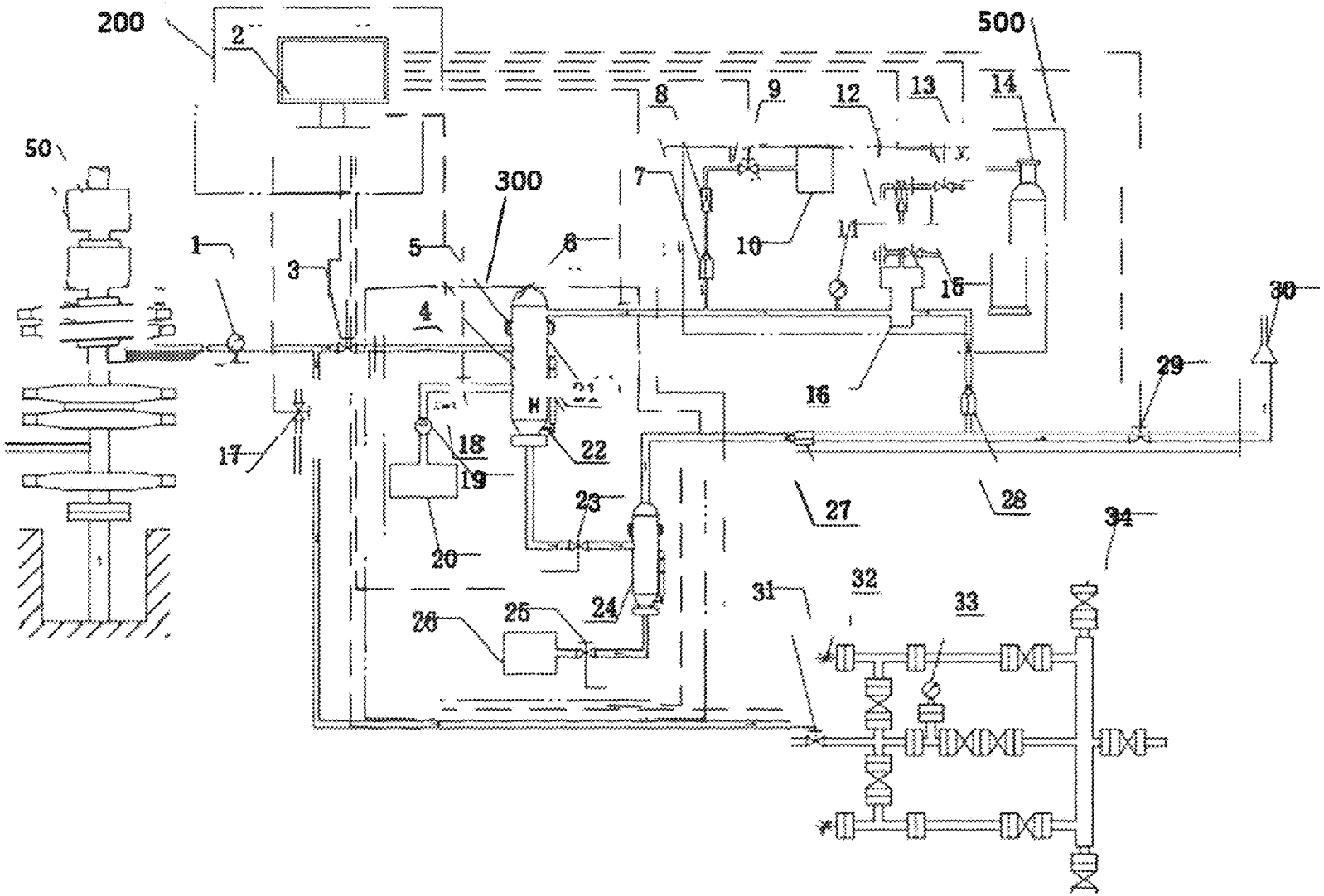
FIG. 3 is a schematic structural diagram of a control device according to another embodiment of the present invention.
Figure 4:
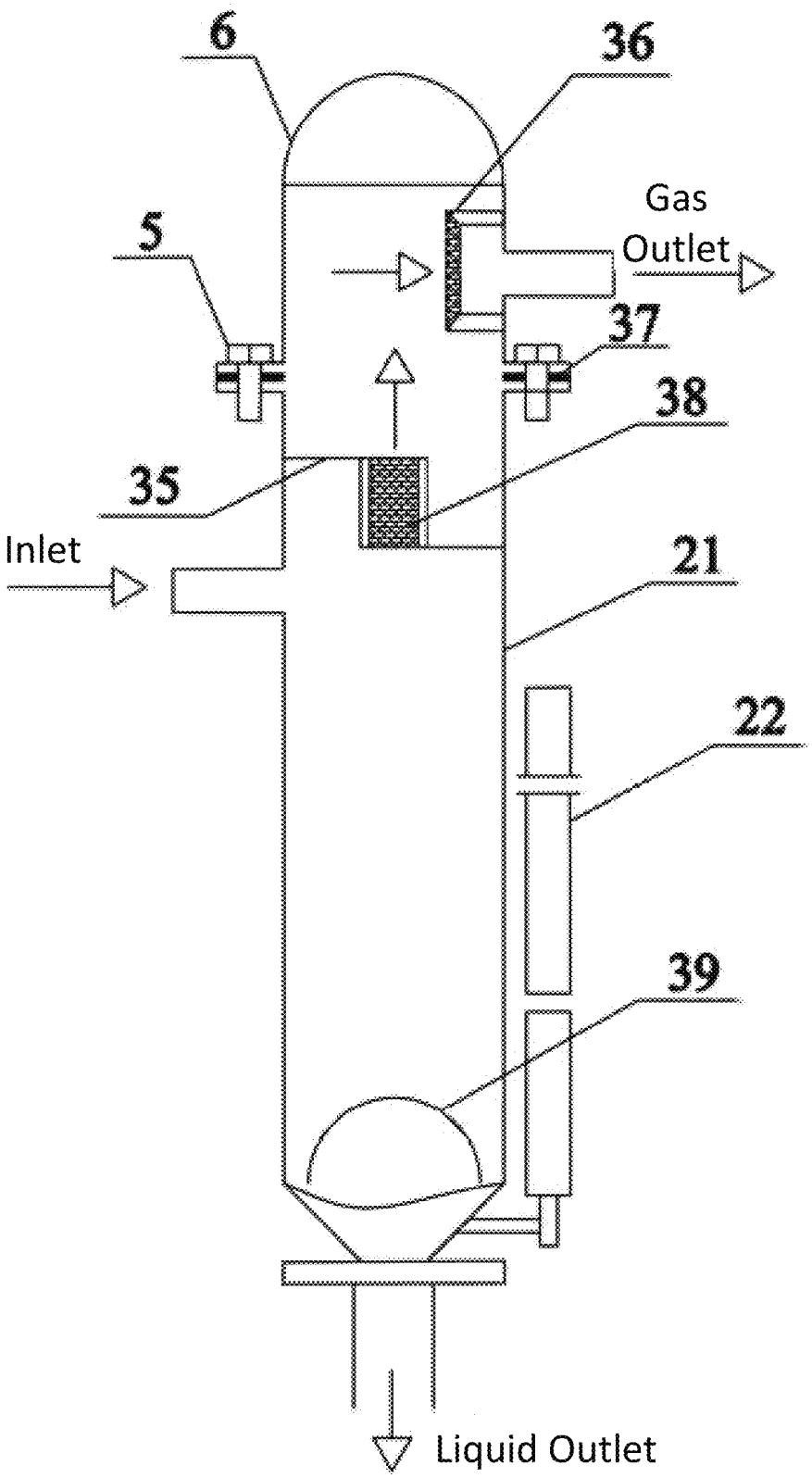
FIG. 4 is a cross-sectional view of an exemplary structure of a gas-liquid separation tank applicable to the control device of the present invention shown in FIG. 3.
Figure 5:
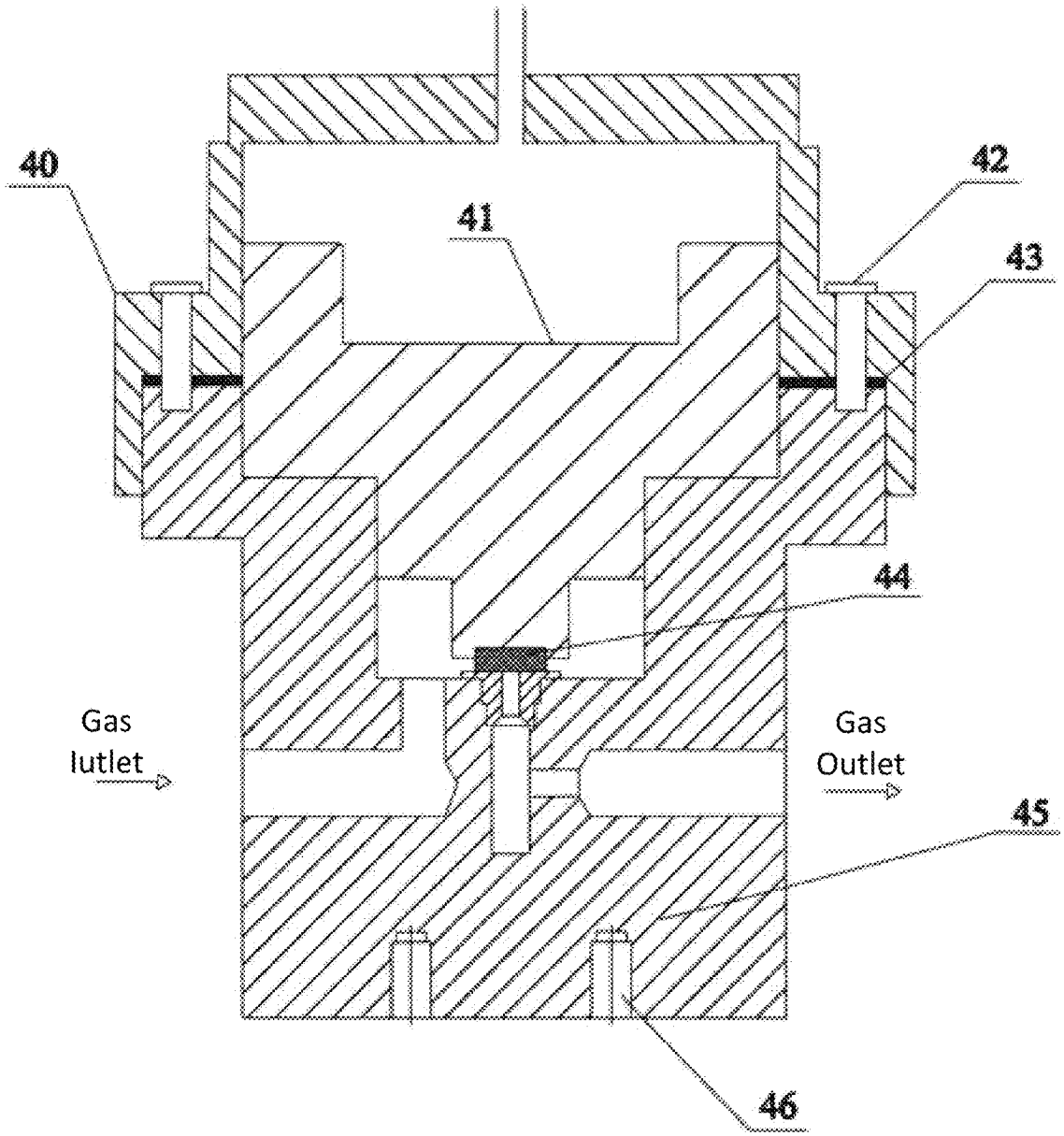
FIG. 5 is a cross-sectional view of an exemplary structure of a back pressure valve applicable to the pressure regulating module shown in FIG. 3.

FIG. 3 is a schematic structural diagram of a control device according to another embodiment of the present invention; FIG. 4 is a cross-sectional view of an exemplary structure of a gas-liquid separation tank applicable to the control device of the present invention shown in FIG. 3; and FIG. 5 is a cross-sectional view of an exemplary structure of a back pressure valve applicable to the pressure regulating module shown in FIG. 3.

As shown in FIG. 3, the control module comprises a control device 2 (such as a computer and a control program) and associated control valves.

The gas-liquid separation module 300 preferably comprises multiple stages to improve the separation effect and increase the processing capacity, and more preferably it comprises a two-stage gas-liquid separation module. As shown in FIG. 3, the gas-liquid separation module includes a first-stage gas-liquid separation tank 4 and a second-stage gas-liquid separation tank 24. The first-stage gas-liquid separation tank 4 and the second-stage gas-liquid separation tank 24 are further provided with a level gauge 22. The inlet of the first-stage gas-liquid separation tank 4 is connected to the wellhead through a pressure gauge 1 and a stop valve 3, and the outlet at the bottom thereof is connected to the inlet of the second-stage gas-liquid separation tank 24 via a throttle valve 23. The outlet of the second-stage gas-liquid separation tank 24 is connected to a solid control system 26 via a throttle valve 25. The neutralizing module comprises a neutralization solution injection pump 19, a neutralization solution storage tank 20, and a throttle valve 18. The solid control system 26 comprises a vibrating screen, a cyclone separator, a centrifugal separator and etc., for separating the drilling debris from the drilling fluid and recycling weighting material in the drilling fluid. The drilling fluid returns to the pit after passing through the solid control system.

The upper outlet of the first-stage gas-liquid separation tank is connected to a back pressure regulation module 500. The back pressure regulation module 500 includes a gas cylinder 14, a gas-operated back pressure valve 16 and a back pressure valve 15. The gas cylinder 14 contains a gas for regulating pressure (i.e., a gas for pressure adjustment) for controlling the gas-operated back pressure valve 16. A pressure reducing valve 12 and a throttle valve 13 are used to control the amount of pressurized gas supplied to the gas-operated back pressure valve 16. The gas passage of an upper chamber of a piston 41 of the gas-operated back pressure valve 16 is divided into two portions, one connected to the gas cylinder 14 through the pressure reducing valve 12 and the throttle valve 13 to increase the pressure in the upper chamber of the piston 41, the other connected to the gas outlet through the back pressure valve 15 to reduce the pressure in the upper chamber of the piston 41; the gas inlet of a lower chamber of a piston 41 of the gas-operated back pressure valve 16 is connected to the upper gas phase outlet (or inlet) of the first-stage gas-liquid separation tank 4 through the pressure gauge 11, and the gas outlet is connected to the burner 30 through a check valve 28 and a throttle valve 29. The gas separated from the overflow drilling fluid is discharged through the gas-operated back pressure valve 16 to the burner 30 and burned there. By controlling the action of piston of the gas-operated back pressure valve 16, the gas pressure inside the first-stage gas-liquid separation tank can be controlled.

The back pressure regulation module 500 may also be provided with a gas source 10 communicated with pipelines between the first-stage gas-liquid separation tank 4 and the gas-operated back pressure valve through the throttle valve 9, the pressure reducing valve 8 and the check valve 7. In this way, a pressure compensation module is formed.

By controlling the back pressure valve module composed of the gas-operated back pressure valve 16 and the back pressure valve 15, when the pressure in the gas-liquid separation tank 4 is too high, the pressure above the piston 41 of the gas-operated back pressure valve 15 can be reduced such that the piston 41 can be raised, whereby the gas in the first-stage gas-liquid separation tank 4 is discharged and the pressure in the first-stage gas-liquid separation tank 4 is reduced. When the pressure in the first-stage gas-liquid separation tank is insufficient, the piston 41 of the gas-operated back pressure valve descends under the pressure above it, thereby blocking the gas discharge from the gas-liquid separation tank 4 while allowing the pressurized gas in the gas source 10 to enter the first-stage gas-liquid separation tank 4 to increase the pressure in the first-stage gas-liquid separation tank 4. Since the gas-liquid separation tank 4 is communicated with the wellhead, the pressure in the gas-liquid separation tank is the wellhead back pressure. Therefore, control of the wellhead back pressure can be realized by control of the pressure in the gas-liquid separation tank 4. In addition, the liquid level in the first-stage gas-liquid separation tank 4 needs to be maintained below its inlet, so that the pressure compensation module formed of the gas source 10, the throttle valve 9, the pressure reducing valve 8 and the check valve 7 can also control the liquid level in the gas-liquid separation tank.

FIG. 4 shows an exemplary structure of the gas-liquid separation tanks 4 and 24 including a bolt 5, a filter shell separation chamber 6, a gas-liquid separation tank filter shell 21, a level gauge 22, a support plate 35, a gasket 37, a fine filter exhaust pipe 38, a liquid separation plate 39, and a fine mesh 36. After the fluid returned through the wellhead enters the gas-liquid separation tank, its flow velocity decreases and the gas and liquid phases are separated under the gravity, the separated liquid flows out from the liquid outlet at the bottom, and the gas flows out from the upper gas outlet.

FIG. 5 shows an exemplary structure of the gas-operated back pressure valve 16, including an upper cover 40, a piston 41, a bolt 42, a gasket 43, a sealing piece 44, a main body 45, and a mounting hole 46. The working principle of the gas-operated back pressure valve 16 is that: the area of the upper piston surface of the gas-operated back pressure valve 16 is $A_u$, the area of the lower piston surface is $A_d$, and that the pressure at the upper part of the gas-operated back pressure valve 16 is maintained as $p_u$ by adjusting the opening of the throttle valve 13 and the pressure reducing valve 12 at the outlet of the gas cylinder 14. The pressure $p_a$ in the gas-liquid separation tank 4 (i.e., the wellhead back pressure) is related to $p_u$ and $A_u$, $A_d$ as shown in the following equation.

$$p_u = \frac{p_a A_a}{A_u}$$

Only an example of the gas-liquid separation tank and the gas-operated back pressure valve are shown in FIGS. 4 and 5. Those skilled in the art may use other configurations of the gas-liquid separation tank and the gas-operated back pressure valve, and other methods may be used to configure the back pressure valve module and the pressure compensation module, as long as the function of back pressure regulation of the present invention can be achieved.

In FIG. 3, the wellhead is also connected to a bypass throttle line through stop valves 17, 31 and adjustable flow valve 32. In FIG. 3, 33 denote a pressure gauge, 34 denotes a drilling fluid gas-liquid separator interface, and 50 denotes a wellhead device.

During the drilling process, the stop valve 3 may be in the normally-open state and the stop valve 17 may be in the normally-closed state. When the fluid returned from the wellhead exceeds the processing capability of the gas-liquid separation module, the stop valve 17 may be opened and the stop valve 3 may be closed so that the fluid flows out through the choke manifold. The choke manifold is an overflow drilling fluid discharge line used when an overflow occurs in the drilling process. In the prior art, stable control of the wellhead back pressure cannot be achieved during the process of discharging the overflow drilling fluid. With the control device of the present invention, not only the wellhead back pressure can be controlled, but also the acid gas in the drilling fluid can be effectively removed during the discharge of the overflow drilling fluid.

In use of the control device shown in FIG. 3, the fluid flow returned through the wellhead during normal drilling is substantially constant, so that the liquid level in the gas-liquid separation tank is also stable. When an overflow occurs, however, since the gas in the overflow drilling fluid occupies part of the volume of the annulus, the drilling fluid originally occupying this space will be discharged through the wellhead, and the amount of fluid discharged through the wellhead into the gas-liquid separation tank will be increased and thus the liquid level in the gas-liquid separation tank rises. Accordingly, the overflow can be detected by detecting the liquid level in the gas-liquid separation tank. In addition, when the overflow occurs, the pressure in the gas-liquid separation tank also fluctuates after the amount of discharged drilling fluid entering the gas-liquid separation tank increases. Therefore, the overflow can be detected by detecting the pressure in the gas-liquid separation tank (for example, the readings of the pressure gauge 1 or 11 shown in FIG. 3).

When the overflow occurs, the control module 200 is further configure to, after performing the shut-in operation: determine whether the gas contains an acid gas based on the actual increase in fluid discharge and a calculated value of the increase in fluid discharge, the calculated value of the increase in fluid discharge is calculated according to a gas state equation; calculate, if the gas contains an acid gas, the total amount of the acid gas based on a methane solubility chart, an acid gas solubility chart, a pressure distribution of the annulus, and the total gas volume; calculate a critical pressure for keeping the acid gas in the supercritical state based on the total amount of the acid gas, a temperature and pressure field of the wellbore, a dissolution pattern and phase state curve of the acid gas; and regulate the wellhead back pressure based on the critical pressure. The total amount of acid gas includes the amount of gaseous-phase gas and the amount of gas dissolved in the overflow drilling fluid (or the amount of supercritical acid gas). The total amount of acid gas and the critical pressure can be calculated according to methods known in the art.

After the critical pressure is calculated, the back pressure regulation module may be controlled by the control module to adjust the wellhead back pressure to a value that keeps the bottom hole pressure at the critical pressure.

The invaded gas refers to the gas from the stratum (here the gas refers to the specific substance, not the state of the substance, and terms such as gaseous state and gaseous phase are used to indicate the state of the substance in the present invention). When the invaded gas contains the acid gas, the increase in the volume of gas actually invading into the drilling fluid is larger than the volume increase calculated from the state equation of methane gas since the solubility of acid gas (such as $H_2S$) is greater than that of natural gas (main component of which is methane). Therefore, it can be determined that the invaded gas contains acid gas when the increase in the volume of gas actually invading into the drilling fluid is larger than the volume increase calculated from the state equation of methane gas.

In the case that the overflow drilling fluid enters the gas-liquid separation tank and it is determined that the invaded gas contains acid gas (such as $CO_2$, $H_2S$, etc.), the neutralization solution injection pump 19 and the throttle valve 18 may be controlled to inject the neutralization solution from the neutralization solution storage tank 20 into the gas-liquid separation tank 4 after the overflow drilling fluid enters the gas-liquid separation tank, so as to neutralize the acid gas dissolved in the overflow drilling fluid or existing in a supercritical state.

The reason for neutralizing the acid gas is explained as follows. The pressure in the first-stage gas-liquid separation tank is relatively large (equivalent to the wellhead back pressure), while the pressure in the second-stage gas-liquid separation tank (or solid control system when there is no second-stage gas-liquid separation tank) is relatively small and usually close to normal pressure. When the overflow drilling fluid is in the first-stage gas-liquid separation tank, a relatively large amount of acid gas is in a supercritical state or dissolved in the liquid due to a large ambient pressure. In this case, when the liquid is discharged from the first-stage gas-liquid separation tank to the second-stage gas-liquid separation tank (or directly to the solid control system), the dissolved acid gas or the supercritical acid gas in the liquid may expand suddenly due to sudden drop of pressure and sudden release of large amounts of gas can impact the follow-up devices, if the acid gas dissolved in the liquid is not neutralized.

The gas separated from the first-stage gas-liquid separation tank and the second-stage gas-liquid separation tank is led to the burner 30 to be burned. In FIG. 3, numerals 27 and 28 indicate check valves for preventing gas from flowing back, and 29 indicates a throttle valve.

Although in the above embodiments the case including first-stage gas-liquid separation tank and second-stage gas-liquid separation tank are explained, a person skilled in the art may only configure one stage of gas-liquid separation tank, or more than two stages of gas-liquid separation tank and provide a neutralization module for each stage of the gas-liquid separation tank when realizing the control device of the present invention.

As the overflow drilling fluid rises from the bottom of the well until it is discharged through the wellhead, the pressure at which the acid gas phase change occurs will change due to the temperature change in the well, and the pressure of the overflow drilling fluid at different well depths will also change. Therefore, in the present invention the control module 200 preferably controls the wellhead back pressure in different stages according to the rising stage of the overflow drilling fluid.

Therefore, controlling the wellhead back pressure based on the increase in fluid discharge may preferably comprises: controlling the wellhead back pressure to a first back pressure in an initial stage after the shut-in operation; controlling the wellhead back pressure to a second back pressure after the initial stage lasting for a predetermined period of time and before gas overflow is detected at the wellhead; and controlling the wellhead back pressure to a third back pressure when gas overflow is detected at the wellhead.

Figure 6B:
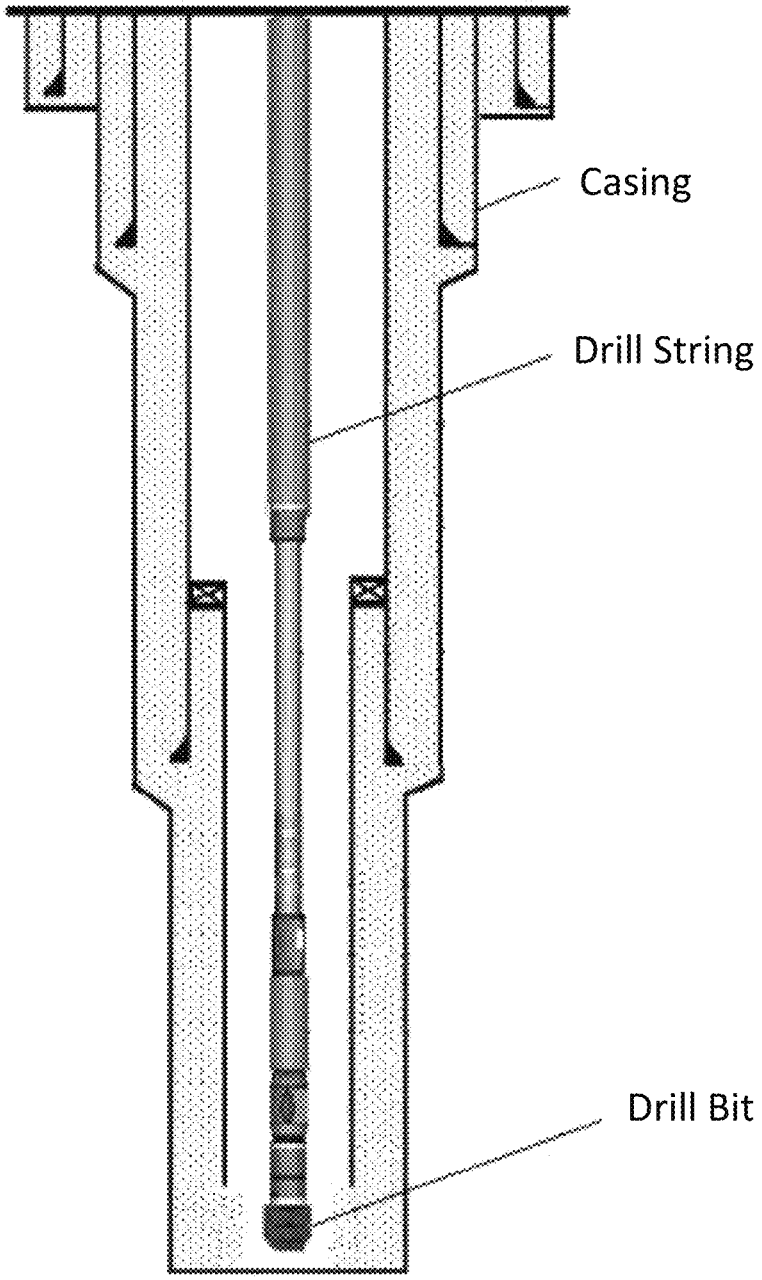

FIGS. 6A and 6B are cross-sectional views for illustrating different well sections during drilling. As shown in FIG. 6A, a casing is provided in a well section near the ground, and there is no casing in the well section near the bottom of the well. The well section without the casing is called the open hole section. FIG. 6A is merely a diagram for illustrating the open hole section and drilling fluid flow direction. The layered structure of respective well sections is shown in FIG. 6B. The space between the drill string and the wall of the well in FIGS. 6A and 6B is called the annulus.

The first back pressure is determined by the following formula:

$$p_{a0} = p_d + \frac{V_{K0}}{A_a}(\rho_m - \rho_{g1})g,$$

$$p_{g1} = \frac{z_0(p_d + p_b)T_0}{z_1 p_0 T_b}\rho_{g0},$$

wherein $p_{a0}$ is the first back pressure, $V_{k0}$ is the increase in fluid discharge when the overflow occurs, $p_d$ is the read riser pressure, $A_a$ is the cross-sectional area of the annulus of the open hole section, $\rho_m$ is the density of the drilling fluid when no invaded gas is present, $\rho_{g1}$ is the density of a gas invaded at the bottom of the well, $z_0$ is the methane compression factor in the standard state, $T_0$ is a temperature in the standard state, $p_0$ is the standard atmospheric pressure, $\rho_{g0}$ is the methane density in the standard state, $T_b$ is the bottom hole temperature, $z_1$ is the methane compression factor at bottom hole temperature and pressure conditions, and $p_b$ is the designed bottom hole pressure. The methane compression factor under different temperature and pressure conditions can be obtained from the relevant standard data table.

After the overflow occurs, the shut-in is performed and the riser pressure $p_d$ is read. The riser pressure can be read from the pressure measuring device of the existing drilling device. The increase $V_{k0}$ in the overflow drilling fluid discharge in the initial stage after shut-in is recorded. The increase can be obtained from change in the liquid level in the drilling fluid pool, or change in liquid level in the gas-liquid separation tank shown in FIG. 3. The initial stage refers to the period between shut-in operation and the elapse of a predetermined period of time.

The second back pressure is determined by the following formula:

$$p_{a1}=p_{a0}+p_{ml},$$

$$p_{ml}=\frac{V_{k1}}{A_{ai}}(\rho_m-\rho_{gi})g,$$

$$\rho_{gi}=\frac{z_0(p_d+p_b-\rho_m g h_i)T_0}{z_i p_0 T_i}\rho_{g0},$$

wherein $p_{a1}$ is the second back pressure, $V_{k1}$ is the increase in fluid discharge when the overflow drilling fluid rises to a depth $h_i$, $A_{ai}$ is the cross-sectional area of the annulus at the well depth $h_i$, $p_{ml}$ is the pressure loss of the drilling fluid column caused before the overflow drilling fluid reached the wellhead, $\rho_{gi}$ is the density of the overflow drilling fluid when it rises to the well depth $h_i$, $z_i$ is the methane compression factor under the temperature and pressure conditions at the well depth $h_i$, $T_i$ is the temperature at $h_i$, $h_i$ being calculated based on pump displacement, gas slippage rate and the predetermined period of time.

$h_i$ may be determined by the following formula:

$$h_i=\int_{t_0}^{t}\frac{Q_{m1}}{A_{ai}}dt+1.53\int_{t_0}^{t}\left[\frac{g(\rho_m-\rho_{gi})\sigma}{\rho_m^2}\right]^{0.25}dt,$$

wherein $Q_{ml}$ is the displacement of the injection pump that injects the original drilling fluid into the well while discharging the drilling fluid out of the well, $t_0$ is the time at which shut-in is performed, and t is the time at which the predetermined period of time elapses, namely, $t-t_0$ is equal to the predetermined period of time.

The third back pressure is determined by the following formula:

$$p_{a2}=p_{a0}+p_{ml2}$$

$$p_{ml2}=\frac{V_{k2}}{A_{a0}}(\rho_m-\rho_{g2})g$$

$$\rho_{g2}=\frac{z_0 p_{a2} T_0}{z_2 p_0 T_2}\rho_{g0}$$

wherein $p_{a2}$ is the third back pressure, $A_{a0}$ is the cross-sectional area of the annulus at the wellhead, $V_{k2}$ is the increase in fluid discharge when the overflow drilling fluid reaches the wellhead, $\rho_{g2}$ is the density of the gas when it reaches the wellhead, $z_2$ is the methane compression factor under the temperature and pressure conditions at the wellhead, and $T_2$ is the temperature at the wellhead. The cross-sectional area of the annulus at different well depths may be obtained according to the well depth. The radius of different well sections is known, so the cross-sectional area of the annulus at different well depths is also known. As shown in part (b) of FIG. 6, the schematic structure of respective well sections composed of casings of different diameters is shown. The diameter of the casings disposed in the respective well sections is known, and the outer diameter of the drill string is also known. Therefore, the cross-sectional area of the annulus in different well sections can be determined accordingly.

Figure 10:
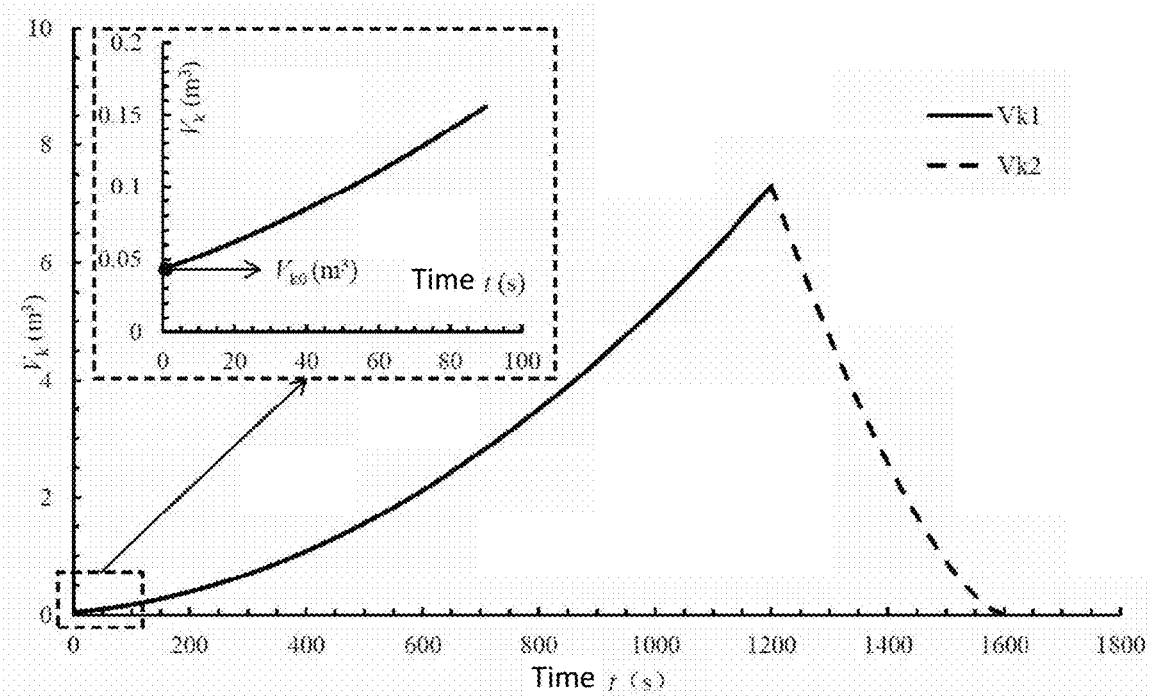
FIG. 10 is an exemplary graph illustrating changes in the increase in fluid discharge when overflow occurs and during discharge of the overflow drilling fluid.

FIG. 10 shows an example of the increase in fluid discharge from the annulus when overflow occurs and during discharge of the overflow drilling fluid. The horizontal axis indicates the elapsed time after the overflow occurs, and the vertical axis indicates the increase in fluid discharge from the annulus. As shown in FIG. 10, the increase $V_{k0}$ in fluid discharge is relatively small due to the fact that the volume of gas is small under the temperature and pressure conditions at the bottom of the well when overflow occurs; as the overflow drilling fluid rises, the gas gradually expands and thus the increase in fluid discharge $V_{k1}$ gradually increases; and when the overflow drilling fluid rises to the wellhead, the fluid increase in discharge $V_{k1}$ gradually decreases because the drilling fluid invaded by the gas is gradually discharged.

In multi-stage control of the wellhead back pressure, the fourth back pressure may be determined by the following formula based on the calculated critical pressure when it is determined that the invaded gas contains acid gas. That is, $p_b$ in the following formula is replaced by the critical pressure. The liquid column pressure $p_m$ in the following formula is calculated based on the density of the invaded gas and the density of the drilling fluid. The fourth back pressure $p_{a3}$ is calculated as follows.

$$p_{a3}=p_b-p_m-p_t$$

Here, the fourth back pressure may be used as the target value of the wellhead back pressure, or this target value may be selected from a maximum value between the first back pressure, the second back pressure, or the third back pressure, and the fourth back pressure depending on the current discharge stage of the overflow drilling fluid. For example, in the case that it is determined that the invaded gas contains acid gas, if the overflow drilling fluid has risen to the stage corresponding to $p_{a1}$ described above, the maximum value among $p_{a1}$ and $p_{a3}$ can be used as the target value of the wellhead back pressure.

Figure 7:
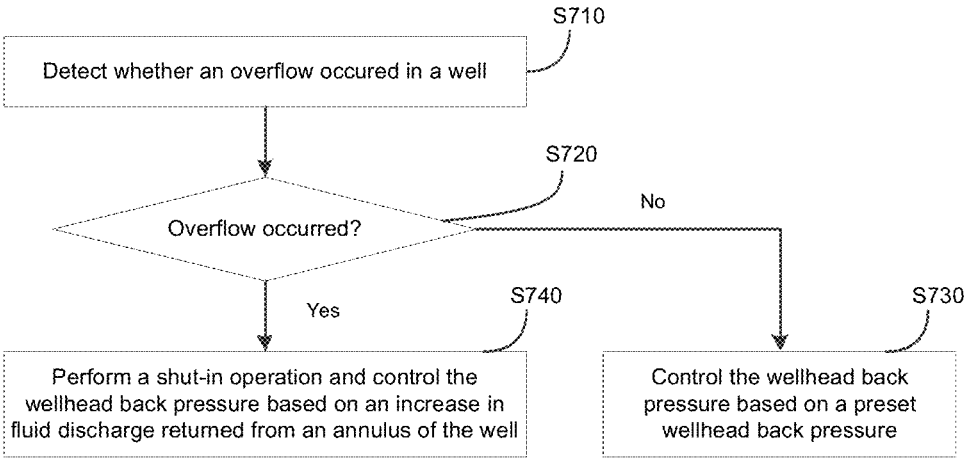
FIG. 7 is a flowchart of a control method according to an embodiment of the present invention.

FIG. 7 is a flowchart of a control method according to an embodiment of the present invention. As shown in FIG. 7, the control method comprises the following steps:

S710-S720 of detecting whether an overflow occurs in a well;

S730 of controlling the wellhead back pressure based on a preset wellhead back pressure when no overflow occurs in the well, in order to keep the bottom hole pressure stable; and

S740 of performing a shut-in operation and controlling the wellhead back pressure based on an increase in fluid discharge returned from an annulus of the well when an overflow occurs in the well, so as to keep the bottom hole pressure stable and prevent the gas from continuing to invade the drilling fluid during the process that the overflow drilling fluid is discharged from the bottom of the well.

Figure 8:
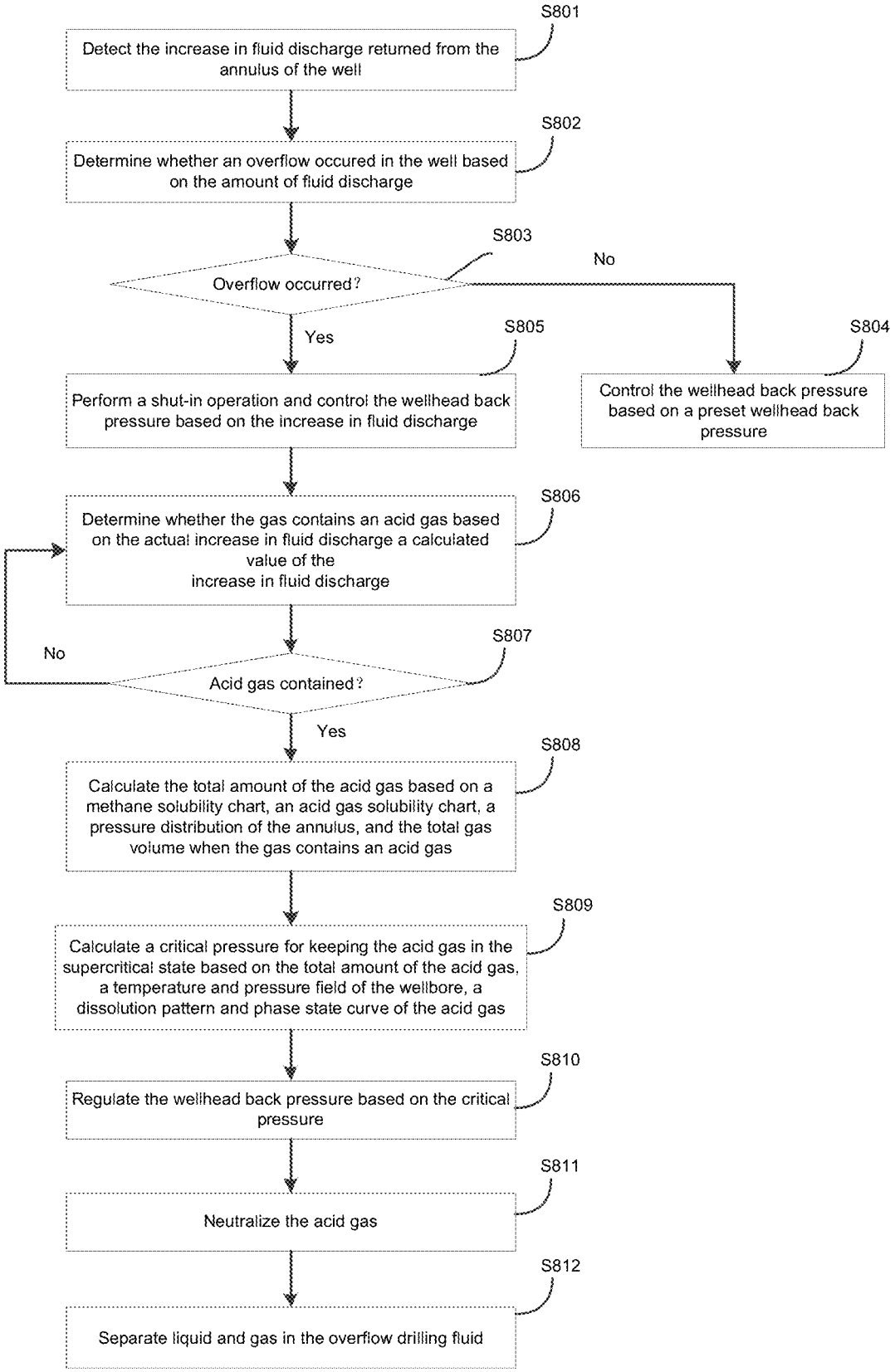
FIG. 8 is a flowchart of a control method according to another embodiment of the present invention.

FIG. 8 is a flowchart of a control method according to another embodiment of the present invention. In a preferred embodiment, the control method comprises the following steps:

S801 of detecting the increase in fluid discharge returned from the annulus of the well;

S802 of determining whether an overflow occurs in the well based on the discharge amount of fluid;

S803-S805 identical to above S720-S744;

S806-S807 of determining whether the gas contains an acid gas based on the actual increase in fluid discharge and a calculated value of the increase in fluid discharge, the calculated value of the increase in fluid discharge is calculated according to a gas state equation;

S808 of calculating, if the gas contains an acid gas, the total amount of the acid gas based on a methane solubility chart, an acid gas solubility chart, a pressure distribution of the annulus, and the total gas volume;

S809 of calculating a critical pressure for keeping the acid gas in the supercritical state based on the total amount of the acid gas, a temperature and pressure field of the wellbore, a dissolution pattern and phase state curve of the acid gas;

S810 of regulating the wellhead back pressure based on the critical pressure to prevent gas in the stratum from continuing to invade the drilling fluid;

S811 of neutralizing the acid gas; and

S812 of separating liquid and gas in the overflow drilling fluid.

FIG. 8 shows the steps of the preferred embodiment of the present invention, and the present invention can be implemented even if some steps are omitted. For example, steps S806 to S810 may be omitted.

Figure 9:
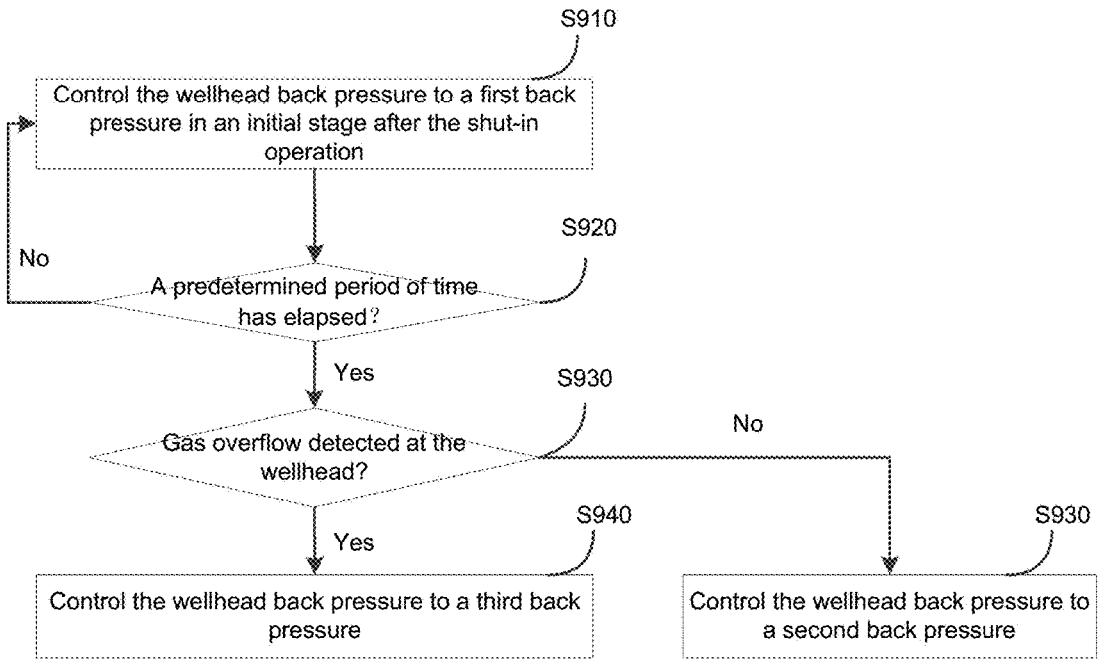
FIG. 9 is a flowchart of a control method according to another embodiment of the present invention.

FIG. 9 is a flowchart of a control method according to another embodiment of the present invention. As shown in FIG. 9, controlling the wellhead back pressure based on the increase in the fluid discharge may comprise the following steps:

S910 of controlling the wellhead back pressure to a first back pressure in an initial stage after the shut-in operation;

S920 of determining whether a predetermined period of time has elapsed after the shut-in operation;

S930 of determining whether gas overflow is detected at the wellhead. This step can be realized by detecting the gas content at the wellhead. When the gas content is greater than 0, it is determined that gas overflow occurs at the wellhead.

S940 of controlling the wellhead back pressure to a second back pressure after the initial stage lasting for a predetermined period of time and before gas overflow is detected at the wellhead; and S950 of controlling the wellhead back pressure to a third back pressure when gas overflow is detected at the wellhead.

The first back pressure, the second back pressure, and the third back pressure may be determined according to the methods described above, and the description will not be repeated here.

When the methane gas is mentioned in the above embodiments of the present invention, it should be understood that the methane gas represents the natural gas in the stratum and does not refer to pure methane gas, but refers to stratum gas free of acid gas such as $H_2S$, $CO_2$, and the like.

The foregoing has described in detail the optional implementations of the embodiments of the present invention with reference to the accompanying drawings. However, the embodiments of the present invention are not limited to the specific details of the foregoing implementations. Within the technical concept of the embodiments of the present invention, various simple variations may be made to the technical solutions of the embodiments of the present invention, and these simple variations all fall into the protection scope of the embodiments of the present invention.

In addition, it should be appreciated that the technical features described in the above embodiments can be combined in any appropriate manner, provided that there is no conflict among the technical features in the combination. To avoid unnecessary iteration, such possible combinations are not described here in the present invention.

Those skilled in the art can understand that all or part of the steps for implementing the method of the above embodiments can be accomplished by a program instructing relative hardware, which is stored in a storage medium with several instructions to make a single chip microcomputer, a chip or a processor to perform all or part of the steps of the method described in the various embodiments of the present application. The foregoing storage medium may include a U disk, a removable hard disk, a read-only memory (ROM), a random access memory (RAM), a magnetic disk, an optical disk, or any other medium that can store program codes.

Moreover, different embodiments of the present invention can be combined freely as required, as long as the combinations do not deviate from the ideal and concept of the present invention. However, such combinations shall also be deemed as falling into the scope disclosed in the present invention.

The invention claimed is:

1. A control method for drilling operations, wherein the control method comprises:

detecting an overflow occurring in a well;

performing a shut-in operation and controlling the wellhead back pressure based on an increase in fluid discharge returned from an annulus of the well, so as to keep the bottom hole pressure stable and prevent a gas in the stratum from continuing to invade drilling fluid during process that overflow drilling fluid is discharged from annular of the well, wherein the controlling the wellhead back pressure based on the increase in fluid discharge returned form the annulus of the well comprises:

controlling the wellhead back pressure to a first back pressure in an initial stage after the shut-in operation;

controlling the wellhead back pressure to a second back pressure after the initial stage lasts for a predetermined period of time and before a gas overflow is detected at the wellhead; and controlling the wellhead back pressure to a third back pressure when a gas overflow is detected at the wellhead wherein the control method further comprises, after performing the shut-in operation:

determining whether the gas contains an acid gas based on an actual increase in fluid discharge and a calculated value of the increase in fluid discharge, the calculated value of the increase in fluid discharge is calculated according to a gas state equation;

calculating, if the gas contains the acid gas, the total amount of the acid gas based on a methane solubility chart, an acid gas solubility chart, a pressure distribution of the annulus, and a total gas volume;

calculating a critical pressure for keeping the acid gas in supercritical state based on the total amount of the acid gas, a temperature and pressure field of the wellbore, a dissolution pattern and phase state curve of the acid gas; and regulating the wellhead back pressure based on the critical pressure to prevent the gas in the stratum from continuing to invade into the drilling fluid, wherein the regulating the wellhead back pressure based on the critical pressure comprises:

calculating a fourth back pressure based on the critical pressure; and regulating the wellhead back pressure based on a stage corresponding to the first back pressure, the second back pressure, and the third back pressure respectively, and a maximum value between the fourth back pressure and one of the first back pressure, the second back pressure, and the third back pressure.

2. The control method according to claim 1, wherein the detecting whether the overflow occurs in the well comprises:

detecting a discharge amount of fluid returned from the annulus of the well; and determining whether the overflow occurs in the well based on the discharge amount of fluid.

3. The control method according to claim 1, wherein the control method further comprises:

separating liquid and gas in the overflow drilling fluid after the overflow drilling fluid is discharged out of the well, when the overflow occurs in the well.

4. The control method according to claim 1, wherein the first back pressure is determined by the following formula:

$$p_{a0} = p_d + \frac{V_{K0}}{A_a}(\rho_m - \rho_{g1})g,$$

$$\rho_{g1} = \frac{z_0(p_d + p_b)T_0}{z_1 p_0 T_b}\rho_{g0},$$

wherein $p_{a0}$ is the first back pressure, $V_{k0}$ is the increase in fluid discharge when the overflow occurs, $p_d$ is the read riser pressure, $A_a$ is cross-sectional area of the annulus of an open hole section, $\rho_m$ is density of the drilling fluid when no invaded gas is present, $\rho_{g1}$ is density of a invaded gas at the bottom of the well, $z_0$ is methane compression factor in a standard state, $T_0$ is temperature in the standard state, $p_0$ is standard atmospheric pressure, $\rho_{g0}$ is methane density in the standard state, $T_b$ is the bottom hole temperature, $z_1$ is the methane compression factor at bottom hole temperature and pressure conditions, and $p_b$ is a designed bottom hole pressure, the second back pressure is determined by the following formula:

$$p_{a1}=p_{a0}+p_{ml},$$

$$p_{ml} = \frac{V_{k1}}{A_{ai}}(\rho_m - \rho_{gi})g,$$

$$\rho_{gi} = \frac{z_0(p_d + p_b - \rho_m g h_i)T_0}{z_i p_0 T_i}\rho_{g0},$$

wherein $p_{a1}$ is the second back pressure, $V_{k1}$ is the increase in fluid discharge when the overflow drilling fluid rises to a depth $h_i$, $A_{ai}$ is cross-sectional area of the annulus at the well depth $h_i$, $p_{ml}$ is a pressure loss of the drilling fluid column caused before the overflow drilling fluid reaching the wellhead, $\rho_{gi}$ is the density of the overflow drilling fluid when it rises to the well depth $h_i$, $z_i$ is the methane compression factor under the temperature and pressure conditions at the well depth $h_i$, $T_i$ is the temperature at $h_i$, $h_i$ being calculated based on pump displacement, gas slippage rate and the predetermined period of time, the third back pressure is determined by the following formula:

$$p_{a2}=p_{a0}+p_{ml2}$$

$$p_{ml2} = \frac{V_{k2}}{A_{a0}}(\rho_m - \rho_{g2})g$$

$$\rho_{g2} = \frac{z_0 p_{a2} T_0}{z_2 p_0 T_2}\rho_{g0}$$

wherein $p_{a2}$ is the third back pressure, $A_{a0}$ is cross-sectional area of the annulus at the wellhead, $V_{k2}$ is the increase in fluid discharge when the overflow drilling fluid reaches the wellhead, $p_{ml2}$ is the pressure loss of the drilling fluid column caused when the overflow drilling fluid reaches the wellhead, $\rho_{g2}$ is the density of the gas when the gas reaches the wellhead, $z_2$ is the methane compression factor under the temperature and pressure conditions at the wellhead, and $T_2$ is temperature at the wellhead.

5. The control method according to claim 1, wherein the preset wellhead back pressure is determined by the following formula:

$$p_a=p_b-p_m-p_t$$

wherein $p_a$ is the preset wellhead back pressure, $p_b$ is a designed bottom hole pressure, $p_t$ is a friction pressure drop, and $p_m$ is a drilling fluid column pressure.

6. A control device for drilling operations, wherein the control device comprises:

a detection module configured to detect when an overflow occurs in a well;

a control module configured to:

perform a shut-in operation and control a wellhead back pressure based on an increase in fluid discharge returned from an annulus of the well when the overflow occurs in the well, so as to keep the bottom hole pressure stable and prevent gas in the stratum from continuing to invade drilling fluid during the process that overflow drilling fluid is discharged from annular of the well, wherein the controlling the wellhead back pressure based on the increase in fluid discharge comprises:

controlling the wellhead backpressure to a first back pressure in an initial stage after the shut-in operation;

controlling the wellhead back pressure to a second back pressure after the initial stage lasting for a predetermined period of time and before gas overflow is detected at the wellhead; and controlling the wellhead back pressure to a third back pressure when gas overflow is detected at the wellhead wherein the control module is further configured to, after performing the shut-in operation:

determine whether the gas contains an acid gas based on an actual increase in fluid discharge and a calculated value of the increase in fluid discharge, the calculated value of the increase in fluid discharge is calculated according to a gas state equation;

calculate, if the gas contains the acid gas, the total amount of the acid gas based on a methane solubility chart, an acid gas solubility chart, a pressure distribution of the annulus, and a total gas volume;

calculate a critical pressure for keeping the acid gas in supercritical state based on the total amount of the acid gas, a temperature and pressure field of the wellbore, a dissolution pattern and phase state curve of the acid gas; and regulate the wellhead back pressure based on the critical pressure to prevent the gas in the stratum from continuing to invade the drilling fluid, wherein the regulating the wellhead back pressure based on the critical pressure comprises: calculating a fourth back pressure based on the critical pressure; and regulating the wellhead back pressure based on a stage corresponding to the first back pressure, the second back pressure, and the third back pressure respectively, and a maximum value between the fourth back pressure and one of the first back pressure, the second back pressure, and the third back pressure.

7. The control device according to claim 6, wherein the detecting whether the overflow occurs in the well comprises:

detecting a discharge amount of fluid returned from the annulus of the well; and determining whether the overflow occurs in the well based on the discharge amount of fluid.

8. The control device according to claim 6, wherein the control device further comprises:

a gas-liquid separation module configured to separate liquid and gas in the overflow drilling fluid after the overflow drilling fluid is discharged out of the well, when the overflow occurs in the well.

9. The control device according to claim 6, wherein the first back pressure is determined by the following formula:

$$p_{a0} = p_d + \frac{V_{K0}}{A_a}(\rho_m - \rho_{g1})g,$$

$$\rho_{g1} = \frac{z_0(p_d + p_b)T_0}{z_1 p_0 T_b}\rho_{g0},$$

wherein $p_{a0}$ is the first back pressure, $V_{k0}$ is the increase in fluid discharge when the overflow occurs, $p_d$ is read riser pressure, $A_a$ is cross-sectional area of the annulus of an open hole section, $\rho_m$ is density of the drilling fluid when no invaded gas is present, $\rho_{g1}$ is density of a gas at the bottom of the well, $z_0$ is methane compression factor in standard state, $T_0$ is a temperature in the standard state, $p_0$ is standard atmospheric pressure, $\rho_{g0}$ is methane density in the standard state, $T_b$ is the bottom hole temperature, $z_1$ is the methane compression factor at bottom hole temperature and pressure conditions, and $p_b$ is a designed bottom hole pressure, the second back pressure is determined by the following formula:

$$p_{a1} = p_{a0} + p_{ml},$$

$$p_{ml} = \frac{V_{k1}}{A_{ai}}(\rho_m - \rho_{gi})g,$$

$$\rho_{gi} = \frac{z_0(p_d + p_b - \rho_m g h_i)T_0}{z_i p_0 T_i}\rho_{g0},$$

Wherein $p_{a1}$ is the second back pressure, $V_{k1}$ is the increase in fluid discharge when the overflow drilling fluid rises to a depth $h_i$, $A_{ai}$ is the cross-sectional area of the annulus at the well depth $h_i$, $p_{ml}$ is a pressure loss of the drilling fluid column caused before the overflow drilling fluid reaching the wellhead, $\rho_{gi}$ is the density of the overflow drilling fluid when it rises to the well depth $h_i$, $z_i$ is the methane compression factor under the temperature and pressure conditions at the well depth $h_i$, $T_i$ is temperature at $h_i$, $h_i$ being calculated based on pump displacement, gas slippage rate and the predetermined period of time, the third back pressure is determined by the following formula:

$$p_{a2} = p_{a0} + p_{ml2}$$

$$p_{ml2} = \frac{V_{k2}}{A_{a0}}(\rho_m - \rho_{g2})g$$

$$\rho_{g2} = \frac{z_0 p_{a2} T_0}{z_2 p_0 T_2}\rho_{g0}$$

wherein $p_{a2}$ is the third back pressure, $A_{a0}$ is the cross-sectional area of the annulus at the wellhead, $V_{k2}$ is the increase in fluid discharge when the overflow drilling fluid reaches the wellhead, $p_{ml2}$ is the pressure loss of the drilling fluid column caused when the overflow drilling fluid reaches the wellhead, $\rho_{g2}$ is the density of the gas when it reaches the wellhead, $z_2$ is the methane compression factor under the temperature and pressure conditions at the wellhead, and $T_2$ is the temperature at the wellhead.

10. The control device according to claim 6, wherein the preset wellhead back pressure is determined by the following formula:

$$p_a = p_b - p_m - p_t$$

wherein $p_a$ is the preset wellhead back pressure, $p_b$ is a designed bottom hole pressure, $p_t$ is a friction pressure drop, and $p_m$ is a drilling fluid column pressure.

* * * * *